US005751269A

United States Patent [19]

Black et al.

[11] Patent Number: 5,751,269

[45] Date of Patent: May 12, 1998

[54] SCANNED FLIP-DISK SIGN IMPROVEMENTS

[75] Inventors: F. Martin Black; G. Frank Dye, both of Greensboro, N.C.

[73] Assignee: Reader Vision, Inc., Greensboro, N.C.

[21] Appl. No.: 761,125

[22] Filed: Dec. 6, 1996

Related U.S. Application Data

[60] Provisional application No. 60/008,795, Dec. 18, 1995.

[51] Int. Cl.[6] ..... G09G 3/34

[52] U.S. Cl. ..... 345/108; 40/447

[58] Field of Search ..... 345/108, 109, 345/110, 111, 903; 340/815.62, 815.64, 815.83, 815.86, 815.87, 815.92; 40/447, 449, 452, 466, 470, 472–473, 484, 493, 501, 605

[56] References Cited

U.S. PATENT DOCUMENTS

| | | | |
|---|---|---|---|
| 4,264,906 | 4/1981 | Wakatake | 340/764 |
| 4,380,897 | 4/1983 | Seibert | 40/447 |
| 4,466,207 | 8/1984 | Salam | 49/449 |
| 4,597,209 | 7/1986 | Hukill | 40/447 |
| 4,663,870 | 5/1987 | Bodet et al. | 40/447 |
| 4,729,067 | 3/1988 | Ohe | 362/26 |
| 4,761,905 | 8/1988 | Black | 40/447 |
| 4,779,082 | 10/1988 | Salam | 340/764 |
| 4,783,081 | 11/1988 | Eckhardt | 40/447 |
| 4,819,357 | 4/1989 | Salam | 40/449 |
| 4,912,442 | 3/1990 | Black | 345/108 |
| 5,054,219 | 10/1991 | Hoyt et al. | 40/473 |
| 5,057,828 | 10/1991 | Rousseau | 340/815.62 |
| 5,063,377 | 11/1991 | Smith | 345/110 |
| 5,184,116 | 2/1993 | Daugherty et al. | 340/764 |
| 5,329,717 | 7/1994 | Follis | 40/605 |
| 5,412,891 | 5/1995 | Black et al. | 40/447 |
| 5,600,908 | 2/1997 | Hogberg | 40/449 |

*Primary Examiner*—Richard Hjerpe
*Assistant Examiner*—Ricardo Osorio
*Attorney, Agent, or Firm*—Rhodes Coats & Bennett, L.L.P.

[57] ABSTRACT

A modular display apparatus for displaying indicia at a front thereof has an inner frame with horizontal support beams, the inner frame supporting a plurality of grid modules, at least one grid module being located above another. A plurality of pixels rotationally mounted to the grid modules each include first and second display faces joined along respective adjacent edges. The pixels have a center of gravity located on each pixel so as to interact with an external force applied to the pixel and provide a complete rotation, with a minimum of bounce, to display a desired display face. A triggering mechanism has a plurality of solenoids adapted for selective actuation to rotate selected ones of the pixels for changing the pattern of the desired display indicia controlled by an electronic signal transmitted from an electronics system. The electronics system causes the solenoids to fire in two steps, including a first step of applying full voltage to each solenoid for a fixed period of time and a second step of applying a significantly lower "hold" voltage to the solenoid for the remaining time the solenoid is activated. A single cable drive system drives the triggering mechanism in bidirectional motion.

32 Claims, 7 Drawing Sheets

SCANNED FLIP-DISK SIGN IMPROVEMENTS

Applicant claims the benefit of the filing date of provisional application Ser. No. 60/008795, namely Dec. 18, 1995, for this application.

FIELD OF THE INVENTION

The present invention relates to a display apparatus for displaying alphanumeric and/or graphical information. More particularly, the present invention relates to a matrix of columns and rows of display elements that can be changed from one display state to another, in order to alter the arrangement of the display elements, thus changing the displayed alphanumeric and/or graphical information.

BACKGROUND OF THE INVENTION

The present invention provides improvements in changeable signs. One of the inventors of this application, Fred. M. Black, is the inventor of U.S. Pat. No. 4,761,905 entitled "Scanned Electromechanical Display" and U.S. Pat. No. 4,912,442 entitled "Scanned Electromechanical Alphanumeric Display Apparatus". The co-inventors of this application, Fred. M. Black and G. Frank Dye are the co-inventors of U.S. Pat. No. 5,412,891 entitled "Changeable Sign". The disclosures of these three patents are hereby incorporated herein by reference. The '905 and '442 patents provide a description of certain of the prior art in the field of the present invention.

The cited patents disclose sign elements which can display alphanumeric or graphical information, through the selective arrangement of individual pixels. The pixels are rotatably mounted elements having multiple display faces, only one of which is noticeable to an observer at a time. The overall pattern of pixel display faces comprises the alphanumeric or graphical indicia of the sign. These prior patents disclose arrays of such pixels and actuator devices which pass behind the arrays to selectively rotate the pixels, causing a new display face of a rotated pixel to be noticeable and, thus, changing the displayed indicia of the sign. The present invention has these notions in common, but provides improved design features to create a superior product.

More specifically, the '442 patent disclosed a display apparatus having a plurality of rotationally mounted display elements that are arranged into a grid matrix of rows and columns, each display element having first and second display faces perpendicular to each other and joined along respective adjacent edges. Each display element also has first and second ramp surfaces rigidly connected along inside edges of and extending substantially away from a back surface of the first and second faces. The display apparatus also includes a series of solenoids, which strike the ramp surfaces of the display elements, causing the display elements to rotate 90 degrees. The solenoids are mounted on a carriage that moves bidirectionally on a horizontal path behind the display apparatus. The carriage has wheels attached to the top and bottom, which ride along tracks at the top and bottom of the display apparatus.

The grid configuration of the '442 display apparatus is modular only in the horizontal direction and, thus, modules must be built to the full height of the sign. Likewise, the sign uses a single carriage, which is also built to the full height of the sign. Thus, construction of the grid and carriage is difficult, costly, and inflexible. A set of modules only permits constructing signs of a single height.

The single carriage of the '442 display apparatus is driven by a dual cable drive system, having independent drums and cables on the top and bottom. The two sets of drums and cables must be precision machined and matched in order to prevent the carriage from skewing from vertical when traversing behind the pixel elements.

The electronics controlling the solenoids in the '442 apparatus cause the solenoids to fire and release for each pixel. The voltage applied to each solenoid causes peak currents in excess of seventeen amps (at 13.5 V) and average currents of over 10 amps. A commercially useful apparatus requires solenoids with lifetimes in excess of five million cycles, which is considerable, given these circumstances, so that early failure can be a problem.

The shape and mounting of the pixels was a major improvement introduced by the '891 patent. The display faces were designed to be cylindrically concave, with the axis of concavity being parallel to the pixel's axis of rotation. Also, the ramp surfaces were given different configurations. These modifications allowed the pixels to be arranged in closer proximity to one another. The pixels included a hub that was mounted to a wire that served as the axis of rotation and was suspended between two vertical supports. However, the pixel design was still complex and did not assure reliable transitions from one display state to the other.

Thus, there exists a need for a scanned pixel sign that is more versatile, sturdier, less costly, and has a reliably longer commercial lifetime.

SUMMARY OF THE INVENTION

The present invention fulfills the need in the art by providing a more versatile, sturdier, and more reliable changeable sign that is fully modular, both horizontally and vertically. It also saves costs by minimizing power consumption through the use of improved solenoid electronics. The improved electronics also enable the solenoids, and thus the entire sign, to achieve a projected commercial life of well over 10 years. The display elements of the present invention are also less expensive to produce in that they require less material and rely on center of gravity configurations to achieve proper rotation.

The present invention provides a modular display apparatus for displaying indicia at a front thereof, including an inner frame having horizontal support beams, each horizontal beam having an upper surface and a lower surface. The inner frame supports a plurality of grid modules, at least one grid module being located above another grid module. The dimensions of the grid modules are designed to allow the grid modules to be placed close enough together, in the vertical and horizontal planes, that they appear as one large continuous grid.

A plurality of pixels are rotationally mounted to each grid module and arranged into a matrix of rows and columns. The pixels each have a predetermined center of gravity and an axis of rotation. Each pixel includes first and second display faces joined along respective adjacent edges. Only one of the display faces will be displayed at a given time, the arrangement of displayed display faces providing the desired indicia at the front of the display apparatus. Each pixel has an initial position such that its first display face is substantially vertical and its second display face is above the first display face, substantially horizontal and protruding toward the rear of the display apparatus.

The mass and position of the pixel's center of gravity assists in rotating the pixel from one display state to another. The pixel has a weight distribution such that its center of gravity will interact with an external force applied to the pixels, to provide a smooth rotation with a minimum of bounce. This weight distribution may be achieved by a fixed weight attached to each pixel, distributing the center of gravity symmetrically around a point on the second display face, the point being opposite to the joined edges of the first and second display faces and at the rear of the display apparatus when the pixel is in its initial position.

A triggering mechanism is adapted for bidirectional movement behind the pixels along a plurality of horizontal support beams. A protuberance is formed in the upper surface of each horizontal support beam (except perhaps the topmost beam) and a protuberance is formed in the lower surface of each horizontal support beam (except perhaps the lowermost beam), enabling each of the upper and lower horizontal support beams to accept at least one carriage.

The triggering mechanism has a single cable drive system and a plurality of carriages, each carriage carrying a plurality of solenoids adapted for selective actuation to rotate selected pixels for changing the pattern of the desired display indicia. The solenoids are controlled by an electronics system which causes the solenoids to fire in a two-step firing method, including a first step of applying full voltage to each solenoid for a fixed period of time and a second step of applying a significantly lower "hold" voltage to the solenoid for the remaining time the solenoid is required to remain activated.

Each grid module is a one-piece injection molded matrix, typically including several important design features. For example, each grid includes a plurality of mounting through-extending C-shaped apertures for rotationally mounting the pixels on axles on the grid. The pixels simply snap onto the axles. Each grid may also include a plurality of molded mounting tabs for attaching the grid modules to a horizontal channel formed in each horizontal support beam. Additionally, each grid may include a plurality of molded stop tabs to restrict the rotation of the pixels. Lastly, each grid may include a plurality of molded flags located on the grid module to indicate a position reference to the triggering mechanism.

A plurality of the mounting tabs are molded to the top of the rear of the grid modules and a plurality of the mounting tabs are molded to the bottom of the rear of the grid modules. The top mounting tabs and the bottom mounting tabs are staggered with respect to each other to allow the tabs of vertically stacked modules to fit interstitially into the same horizontal channel. Each grid module has one corner anchored to the horizontal channel, the anchored corner being the same on each horizontally aligned grid module, in order to force any thermal expansion of the horizontally aligned grid modules to occur in a uniform direction, thereby minimizing misalignment due to the thermal expansion.

BRIEF DESCRIPTION OF THE DRAWINGS

This invention will be better understood from a reading of the Detailed Description of the Preferred Embodiment along with a review of the drawings, wherein like items are indicated by the same reference number.

DETAILED DESCRIPTION OF THE PREFERRED EMBODIMENTS

Figure 1A:
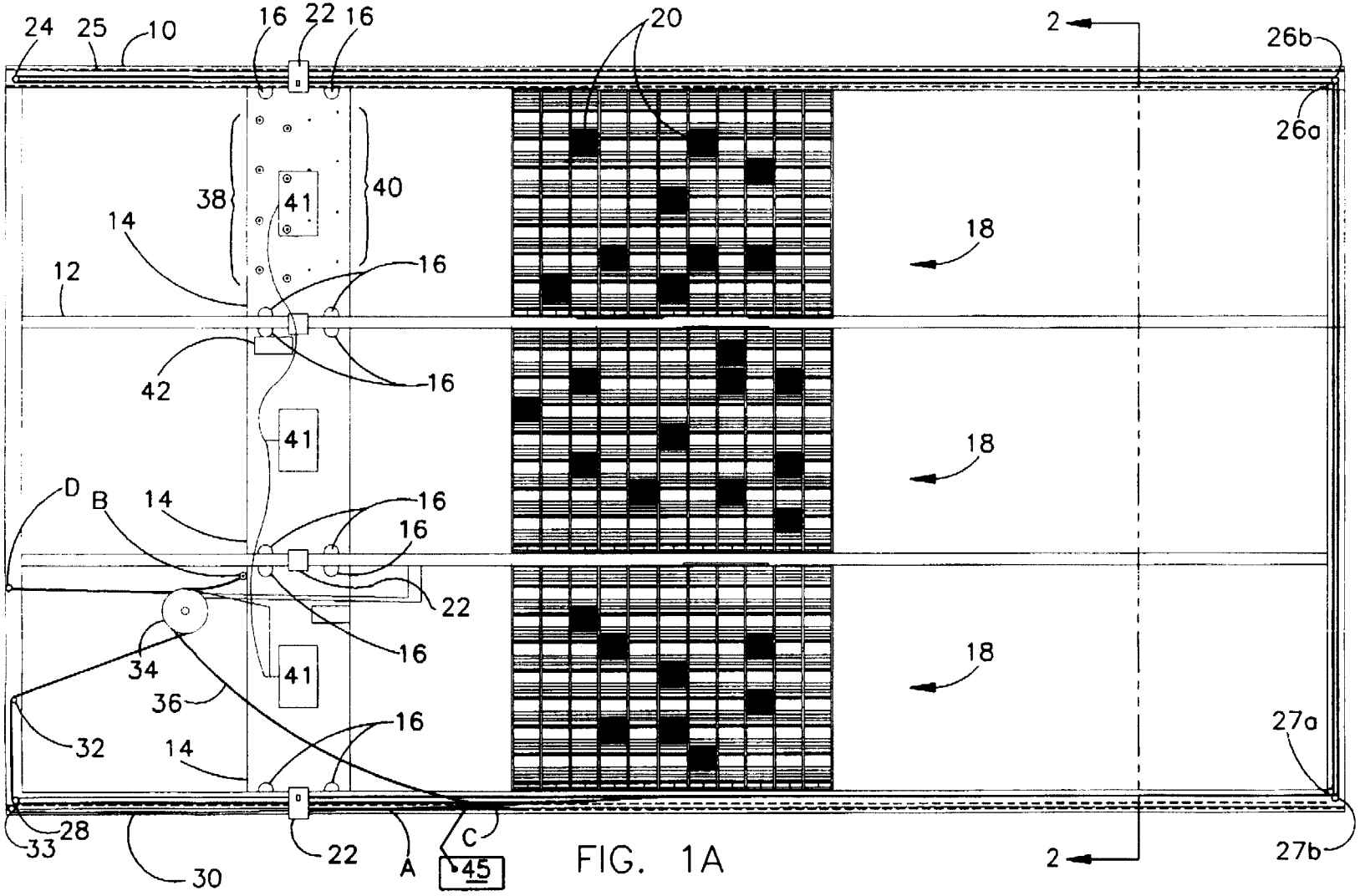
FIG. 1A is a rear elevation view of a display apparatus according to a preferred embodiment of the present invention.

With reference to FIG. 1A, the overall layout of the preferred embodiment of the present display apparatus is shown. The display apparatus has an inner frame 10, which is a square or rectangular section aluminum extrusion fabricated to the dimensions of the required sign. Attached to the frame are extruded aluminum horizontal support beams 12. Beams 12 serve two purposes: to provide guides for carriages 14 by capturing carriage wheels 16, and to capture grids 18, insuring that the horizontal and vertical positioning of the grids with relation to carriages 14 remains accurate and precise.

Figure 2:
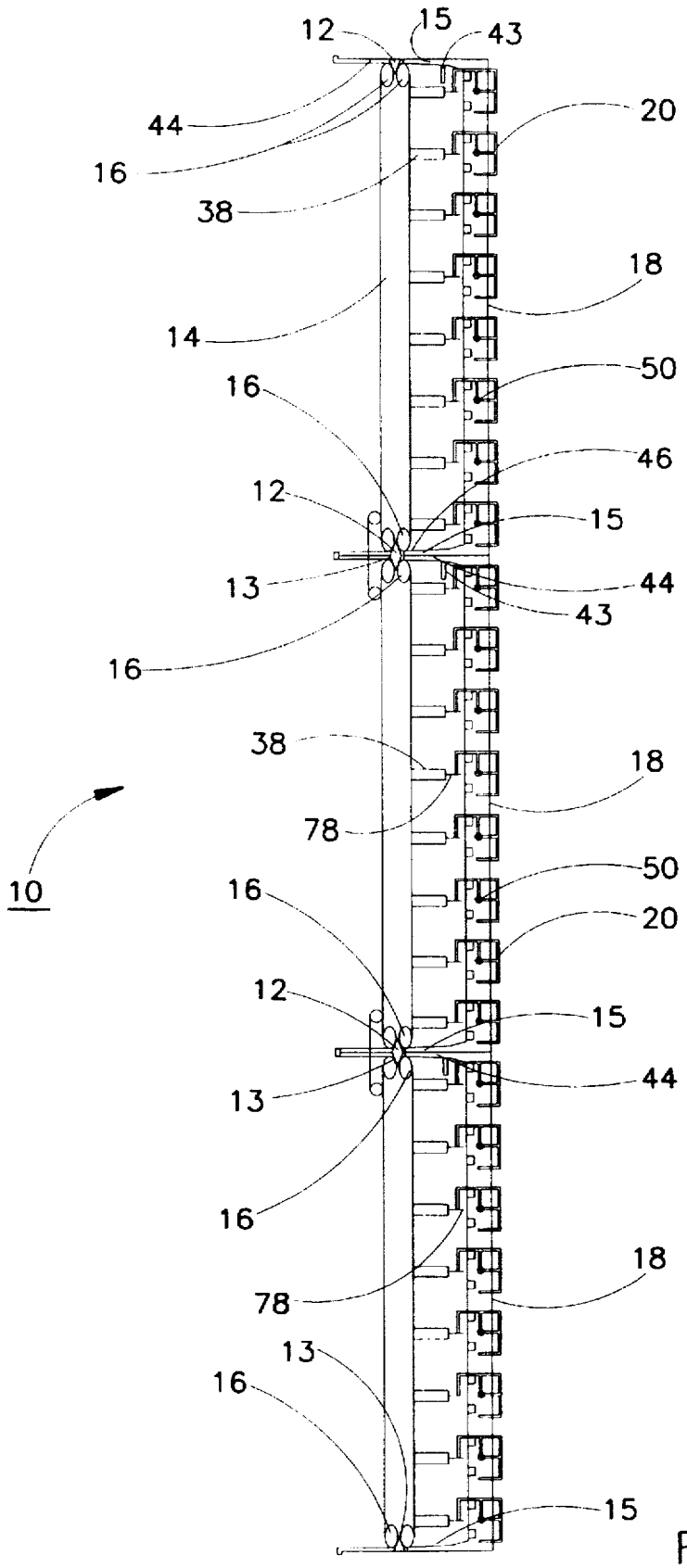
FIG. 2 shows an enlarged, partial sectional view of the assembled display apparatus of FIG. 1A, taken along lines 2—2 and looking in the direction of the arrows.

Each carriage 14 contains four wheels 16, two positioned at the top of the carriage and two positioned at the bottom of the carriage. As shown in FIG. 2, wheels 16 have an internal V-shaped groove that rides on a complementary V-shaped protuberance 13 in the horizontal support beam 12 to assure horizontal and front-to-rear positioning of carriage 14. Protuberance 13 is recessed to prevent damage when handling. Therefore, three carriages would require four horizontal support beams. The design is such that multiple carriages may be vertically stacked to produce a tall sign. The preferred embodiment of the display apparatus contains up to six carriages stacked vertically. The limit depends on the weight and sturdiness of the frame structure and the practicality of handling large assembled signs.

Horizontal support beams 12 are also designed to capture and support vertically stacked grid modules 18, assuring the vertical positioning of one grid module to another. Only one vertical stack of modules is seen in the FIG. 1A for simplicity. Each horizontal support beam 12 captures vertically stacked grid modules 18 by way of a horizontal channel 15 (shown in FIG. 2) on the face of horizontal support beam 12 opposite protuberances 13. Vertical positioning of grids 18 is important since the unitary vision of the sign depends on uniform spacing of pixels 20. As can be seen from FIG. 1A, three vertically stacked grid modules 18 require four horizontal support beams 12 and three carriages 14.

Carriages 14 are ganged together vertically to move in unison. They are adapted for bidirectional motion, driven by a drive cable system that utilizes a single motor and a drum 24. The drum has a concave, or modified V, surface (not shown) to insure proper wrapping of the drive cable 25. Several wraps of the drive cable insure sufficient friction to overcome any slippage when driving the carriages 14. The drum operates similar to a windlass.

Figure 1B:
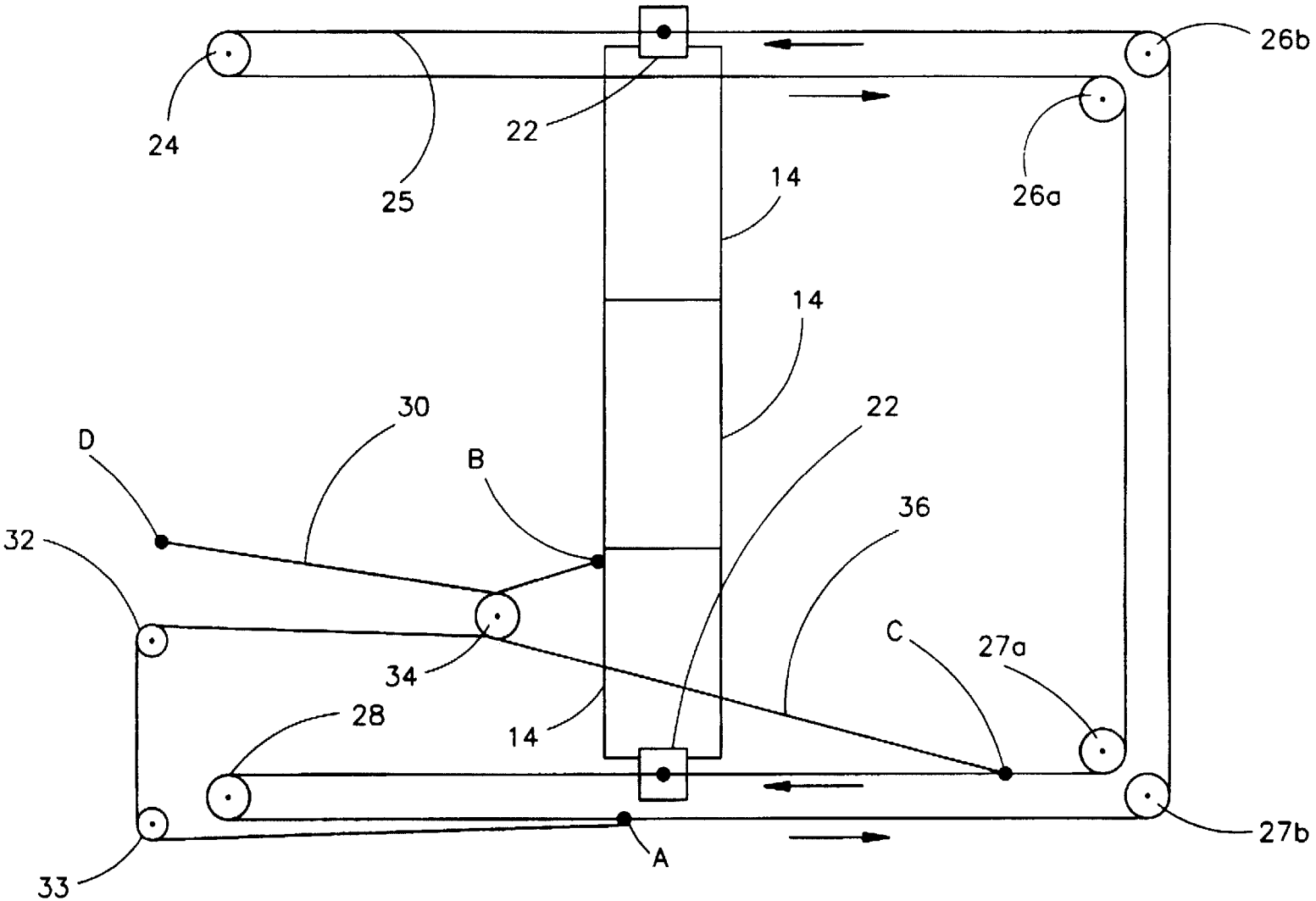
FIG. 1B is a schematic of the cable assembly of the embodiment shown in FIG. 1A.

In the preferred embodiment of the cable system shown schematically in FIG. 1B, drive cable 25 forms a continuous endless loop that runs around the top, one side, and bottom of inner frame 10 (shown in FIG. 1A). From drum 24, located at one end of the upper-most horizontal support beam 12, drive cable 25 travels along a path over drive cable pulley 26*a*, which is positioned at the opposite end of the upper-most horizontal support beam 12. Drive cable pulley 26*a* provides a 90° direction change to feed drive cable 25 down the side of inner frame 10, where drive cable pulleys 27*a* provide a further 90° direction change. Drive cable 25 then travels the length of the bottom-most horizontal support beam 12, where it is wrapped around drive cable pulley 28 to effect a 180° direction change.

Drive cable 25 is then routed back along inner frame 10 in a path parallel to that just described. As before, drive cable pulleys 27*b* and 26*b* provide the necessary 90° direction changes to guide drive cable 25 back to drum 24, where the loop is closed. Drive cable 25 is attached to the uppermost and lowermost carriages 14 by means of connecting brackets 22. The connecting brackets 22 are respectively connected to the portion of the drive cable 25 traveling in the same direction. The configuration of the drive cable 25 allows the portion of drive cable 25 connected to the uppermost carriage 14 to move in the same direction and at the same speed as a portion of drive cable 25 connected at the lowermost carriage 14. Thus, the configuration of drive cable 25 provides uniform horizontal motion for vertically stacked carriages 14.

Vertically stacked carriages 14 are also connected together by additional connecting brackets 22 as shown in FIG. 1A. Brackets 22 allow a small amount of vertical movement between stacked carriages 14 to prevent binding of the carriages on horizontal support beams 12, yet do not allow for any horizontal displacement between the carriages, resulting in constant horizontal alignment.

Shortening of the drive cable 25 and elimination of one drive cable pulley 26, 27 can be accomplished by routing a portion of the drive cable 25 diagonally across the inner frame to provide the direction change. However, in such an embodiment, there is a potential that the diagonal drive cable 25 will snag the carriage as it scans across the sign. Therefore, drive cable 25 is preferably routed away from carriages 14 as shown in FIGS. 1A and 1B along the periphery of the inner frame 10.

At this point, the vertically stacked carriages 14 are driven back and forth via the drum 24 and the drive cable 25. The carriages 14 require a control signal to control the pixels 20. In order to prevent the control signal cable 36 from becoming entangled or caught in the numerous moving part of the sign, a novel pulley system was designed to work in conjunction with the drive cable 25. The signal cable 36 is connected to one of the carriages 14 at point B and to a portion of the drive cable 25 traveling in the same direction as the carriages 14 at point C. A constant tension is kept on the signal cable 36 using a retriever cable 30 operating in conjunction with a movable pulley 34. The retriever cable 30 is fixed at one end to a point D, preferably on inner frame 10. The other end of the retriever cable 30 is routed around pulleys 32 and 33 and ultimately connected to the drive cable 25 at a portion traveling in the opposite direction of the cable at point A. Configuring the retrieval cable 30 in this manner allows the movable pulley 34 to move in the same direction as the carriages 14, but at half the speed, in order to compensate for the pulley action associated with signal cable 36. The net effect of this cable configuration provides constant tension for both the retriever cable 30 and the signal cable 36 as the carriages 14 move in both directions.

As seen in FIG. 1A, each carriage supports a series of eight solenoids 38 equally spaced vertically, except for the top, and a series of eight fixed reset pins 40 that are also equally spaced vertically, except for the top. The top reset pin and solenoid are vertically juxtaposed in order to provide clearances so the desired spacing between the grid modules can be achieved. The timing difference caused by the juxtaposition of the solenoid and reset pin is compensated by electronic means. Each carriage also contains a driver board 41 that controls the eight solenoids 38 on carriage 14. Reset pins 40 may be attached to a movable platform, so the reset function can be controlled. A fixed reset bar may be used if reset on retrace is desired. The reset pins may be replaced by solenoids so selective setting and resetting can be achieved, or a solenoid with an escapement containing a set and reset pin can be used to achieve selective set and reset functions. Selective set and reset is especially useful if the sign is to be changed by a logic seeking technique. Other ways of using escapements or offset solenoid plunger pins could be used, but the embodiment described is the simplest.

Both the solenoids 38 and reset pins 40 are horizontally offset, so that there are four odd numbered solenoids in one column, four even numbered solenoids in a second column, four odd numbered reset pins a third column, and four even numbered reset pins in a fourth column. The utilization of separate columns provides a time lag for the even and odd rows of pixels to set or reset. This allows the pixels to be placed closer together, since vertically adjacent pixels do not rotate at the same time and therefore can each use marginal spaces above and below the pixel volumes during rotation, without interfering with one another.

The solenoids used in the preferred embodiment are either tubular or open frame solenoids and are mounted in holes at the front of the carriage. This technique makes the solenoids virtually self-aligning, eliminating the requirement of a fixture to properly align frame-type solenoids.

The carriage 14 located closest to the vertical midpoint of the sign is provided with an interruptive optical position sensor board 42. The optical sensors sense the presence, or absence, of one of a series of flags 43 molded into each grid module 18. The information from the sensor board provides positioning and column count for the logic circuit (not shown). An alternative is to use positioning sensors for each carriage and logically "OR"ing them together to minimize errors, however, the preferred embodiment uses one board. The sensors use synchronous detection to prevent interference from any ambient light.

The vertically middlemost carriage also contains a "HOME" position sensor, that uses a "Hall Effect" device to determine the carriage's "HOME" position. A second sensor could be used to provide information when the carriage is at the opposite position, however, this is optional.

FIG. 2 shows a sectional view of the assembled display apparatus of FIG. 1A along line 2—2. FIG. 2 shows inner frame 10 and horizontal support beams 12 having protuberances 13 and horizontal channels 15. Horizontal channels 15 receive and capture mounting tabs 44 of vertically stacked grid modules 18. Mounting tabs 44 are anchored to horizontal channel 15 with a pin 46. Also shown in the figure are solenoids 38 secured to the front of carriage 14, and pixels 20 mounted in grid modules 18.

Figure 3:
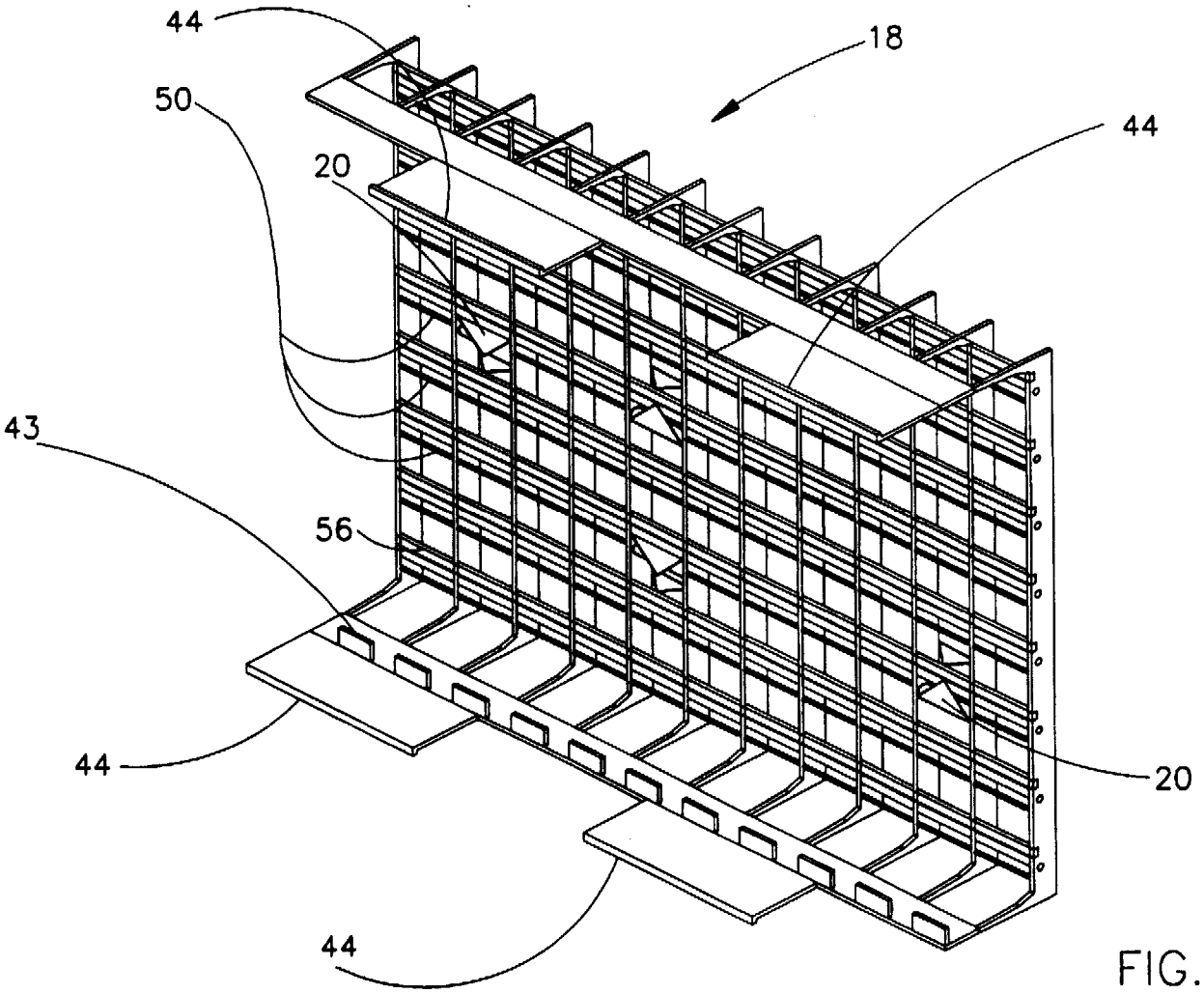
FIG. 3 is an enlarged rear perspective view of an individual grid module.

FIG. 3 shows an individual grid module 18. In the preferred embodiment, grid module 18 is a one-piece injection-molded matrix approximately 12 inches high by 15 inches long. It holds 88 pixels in an array of 8 high by 11 wide. An axle so extends along each row of the module 18. Pixels 20 are loaded through the front of the grid, and snapped onto axles 50 to provide rotational engagement.

Preferably, the pixels have a C-shaped aperture at their center to provide the snap-on engagement. Once in place, a clamp may be used to more securely engage the pixel 20 onto the axle 50. The single axle per row configuration eliminates the need for placing axle tabs directly on the pixels 20 and having corresponding slots on the module 18. The pixels can rotate 90° and are stopped in one of two stable positions by stop tabs 56 molded into the grid.

The grid also has molded-in flags 43 that provide information as to when solenoids 43 are to fire. Flags 38 interrupt light between a light source and receiver (not shown) on the carriage. Molding the flags to the grid module provides accurate positioning relative to each column, which eliminates adjustments between the flags and pixel position. Grid module 18 also has two mounting tabs 44 at the top of the rear and two mounting tabs 44 at the bottom of the rear of the grid module. Top and bottom mounting tabs 44 are staggered with respect to each other, and are attached to horizontal channel 15 in horizontal support beams 12 of inner frame 10.

Figure 4:
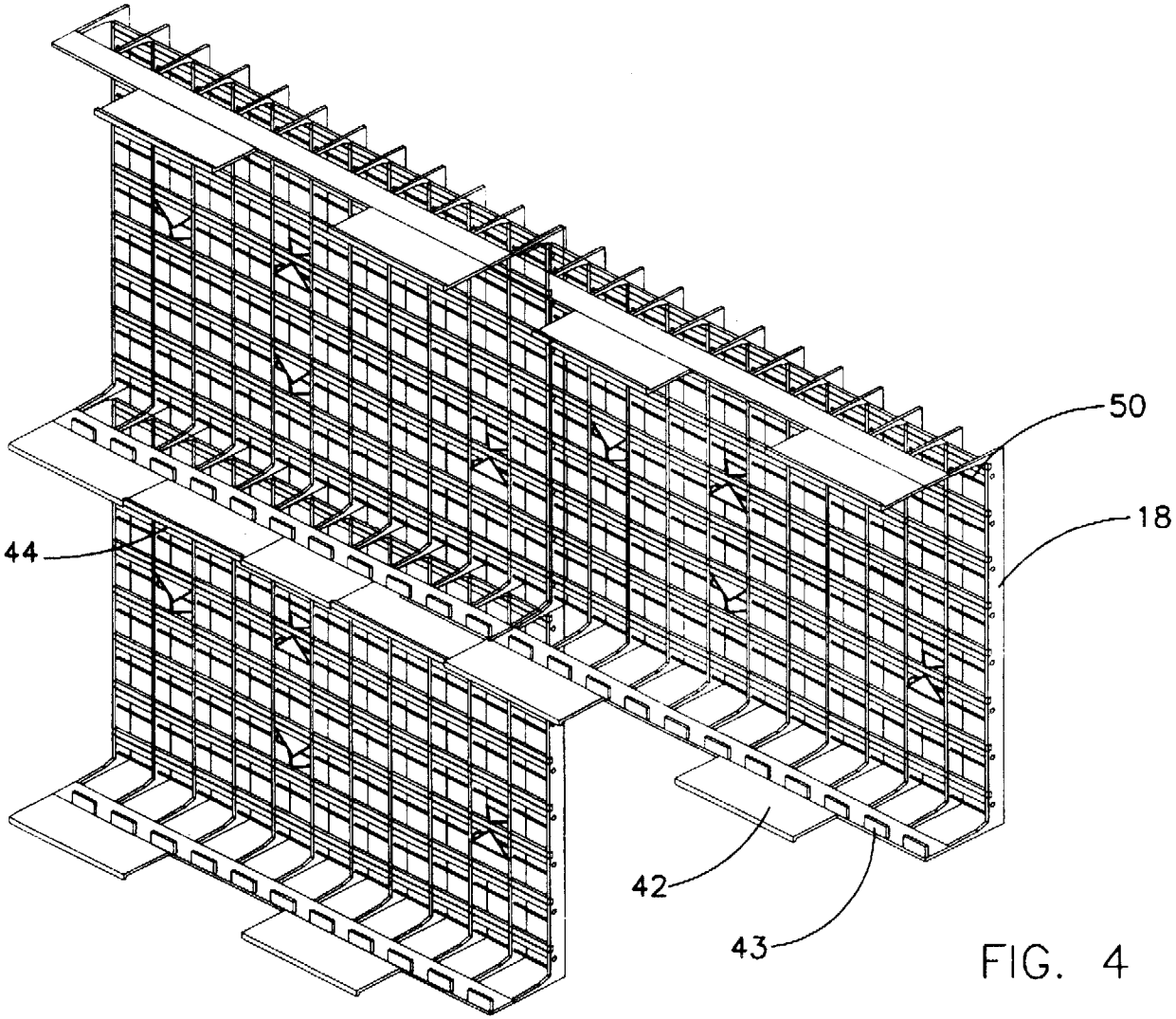
FIG. 4 is a view of several of the grid modules, showing their stackability, both horizontally and vertically, forming the display grid of the display apparatus.

As shown in FIG. 4, grid modules 18 are designed to stack both horizontally and vertically, forming the display face of the sign. The dimensions of grid modules 18 and mounting schemes are designed so that the grid modules may be placed close enough together, in the vertical and horizontal planes, so that they appear as one continuous large grid. Since one horizontal support beam 12 captures two vertically adjacent grid modules 18, the lower portion of an upper module and an upper portion of a lower module, the mounting tabs 44 are staggered to fit interstitially into the same horizontal channel 15 on horizontal support beam 12.

FIGS. 5–7 depict side views of three alternative embodiments of pixels 20. Pixels 20 have a first display face 60 and a second display face 62, which are joined along respective adjacent edges 64. Pixels 20 also include sloping ramp surfaces 68, which, when struck by solenoids 38 or reset pins 40, cause the pixels to rotate about axis 70. Pixels 20 are designed such that the center of gravity of the pixels interacts with an external force applied by the solenoids to provide smooth rotation of the pixels with a minimum of bounce.

Figure 5C:
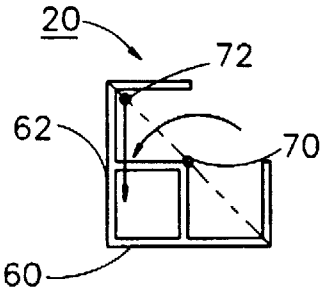
FIGS. 5A–5C show sequential side views of a first embodiment, second embodiment and third embodiment of the individual pixels, demonstrating the pixels' weight distribution during operation.
Figure 5B:
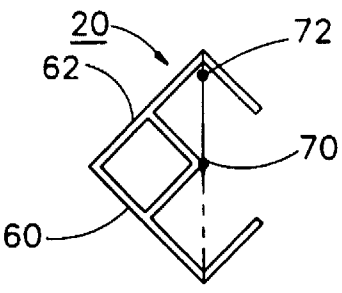
Figure 5A:
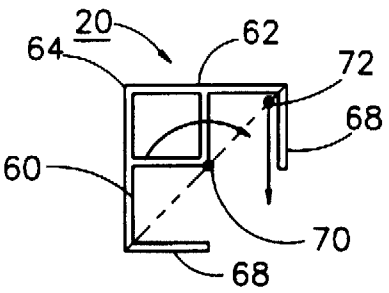

In the embodiment shown in FIGS. 5A–5C, the pixel has a fixed weight 72 to locate the center of gravity, CG, of the assembly to a point approximately 45° up from behind the axis of rotation 70. Weight 72 is designed to distribute the center of gravity symmetrically around the 45° line when pixel 20 is in the reset position (FIG. 5A). The CG moves directly above axis of rotation 70 when pixel 20 is in transition at a 45° angle (FIG. 5B). The CG then moves to a position 45° up from the front of axis of rotation 70 when pixel 20 is in the set position (FIG. 5C). The mass and position of the CG assists in switching pixel 20 from the set, or reset, position to the reset, or set, position when reset pins 40 or solenoids 38 strike their respective ramp surfaces 68. That is, the center of gravity of the pixels has two stable equilibria—the set and reset positions—and the transitions between them are unstable, inducing the pixel to remain in one of the equilibrium positions once so directed.

Figure 6C:
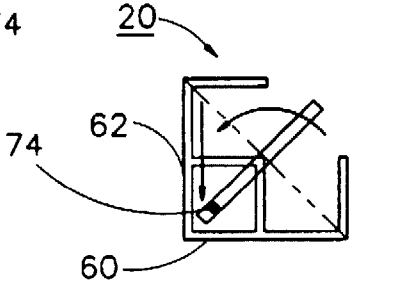
FIGS. 6A–6C show sequential side views of a first embodiment, second embodiment and third embodiment of the individual pixels, demonstrating the pixels' weight distribution during operation.
Figure 6B:
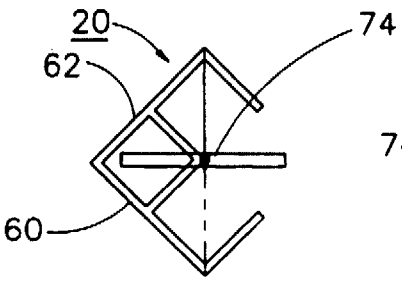
Figure 6A:
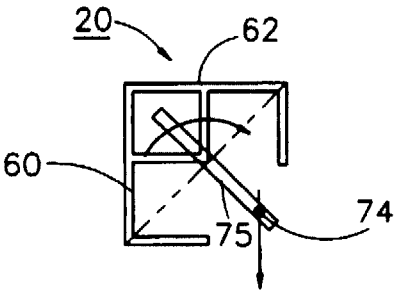

FIGS. 6A–6C show an alternate embodiment, where the CG is variable and is achieved by a weight that is allowed to move diagonally across the vertical plane of axis of rotation 70 to shift the CG. One approach is to use ball bearing(s) 74 in a small tube 75 attached to axis 70 (FIG. 6A). As pixel 20 rotates past the 45° point (FIG. 6B), bearing(s) 74 shift from one end of tube 75 to the other (FIG. 6C). Sand, glass balls, lead shot, or any other flowable material may be used in tube 75.

Figure 7C:
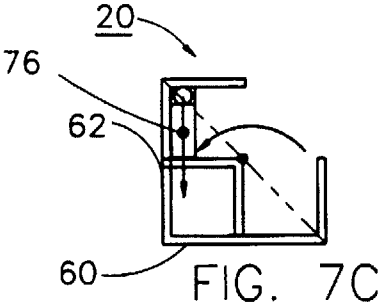
FIGS. 7A–7C show sequential side views of a first embodiment, second embodiment and third embodiment of the individual pixels, demonstrating the pixels' weight distribution during operation.
Figure 7B:
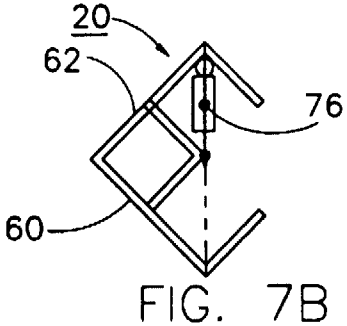
Figure 7A:
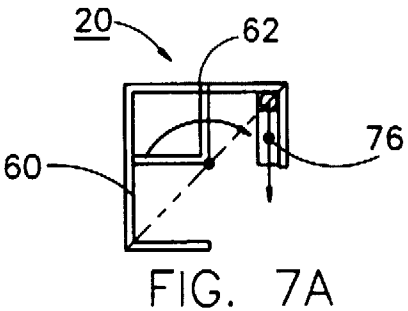

FIGS. 7A–7C show another embodiment, where the variable CG is achieved by means of a suspended or swinging weight 76, which is attached to the top far end of pixel 20. Since weight 76 hangs plumb, the CG is initially behind axis of rotation 70 (FIG. 7A). As pixel 20 rotates beyond 45° (FIG. 7B), the CG shifts to in front of the axis of rotation 70 (FIG. 7C).

Figure 8:
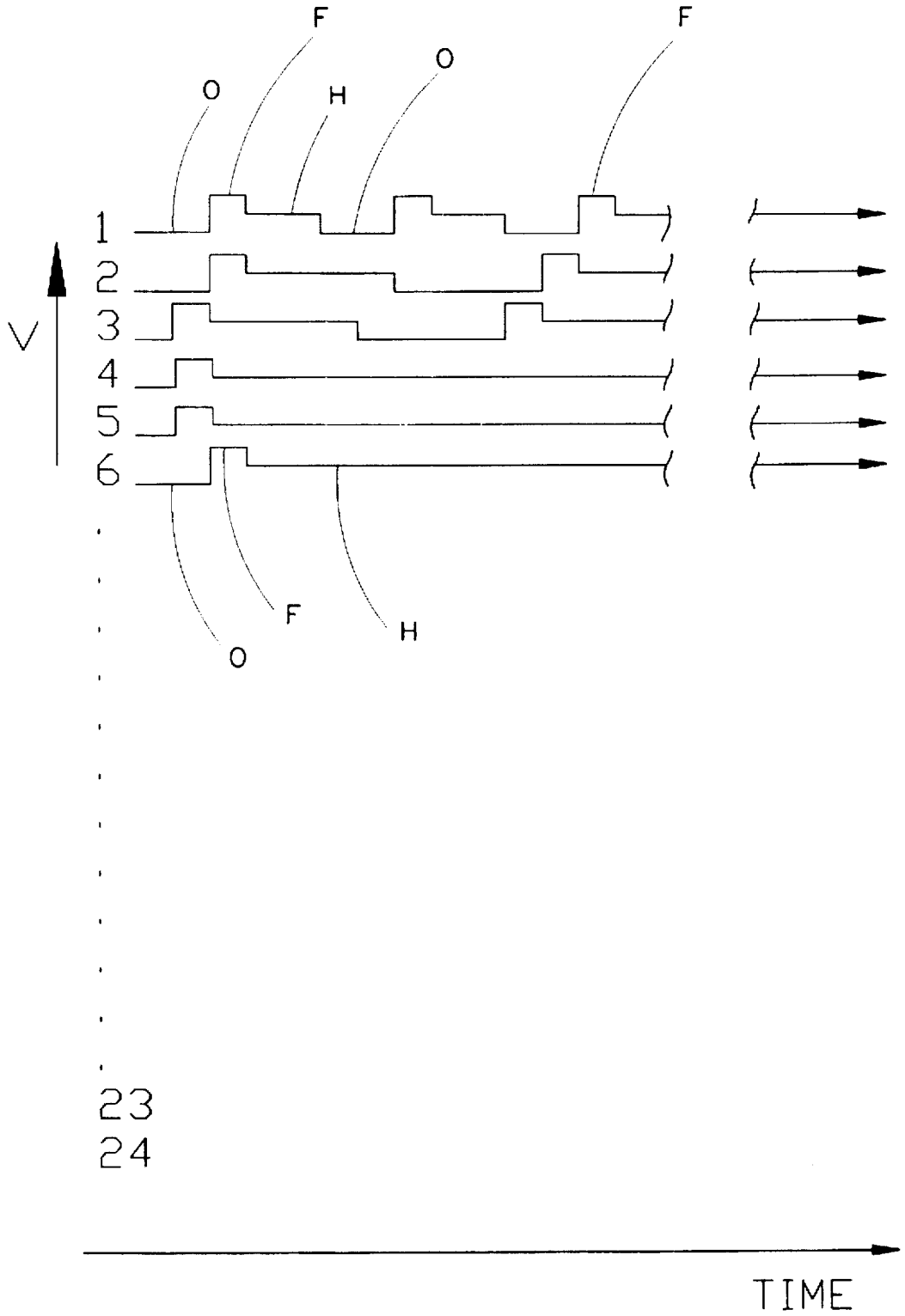
FIG. 8 shows a state diagram of output voltages from the electronics system that are applied to the solenoids.

FIG. 8 shows a state diagram of output voltage signals applied to various solenoids 38 from a computer 45 (shown in FIG. 1). The output voltages represented in FIG. 8 are arbitrary and are meant only to illustrate the operation of solenoids 38. The basic operation of a solenoid 38 is as follows: the solenoid fires (indicated in the state diagram by the first spike in voltage) ejecting plunger 78 (as shown in FIG. 2), which strikes ramp surface 68 of pixel 20, causing the pixel to rotate about axis 70; the solenoid is then held in the fired position (indicated in the state diagram by the intermediate drop in voltage) as long as there is a required change of state for the next horizontally adjacent pixel; the solenoid then releases (indicated in the state diagram by the drop to zero voltage), pulling the plunger back inside.

Solenoids of the prior art are fired or released at each column of pixels. If adjacent columns of pixels all require setting, the solenoid would release and fire for each column. This method requires solenoids with lifetimes in excess of 5,000,000 cycles. Full voltage was also applied to each solenoid, causing peak currents in excess of 17 amps, at 13.5 volts, and average currents of over 10 amps.

The solenoid used in the present invention improves upon the prior art by incorporating a two-step firing method. The improved two-step firing method will not change the state of the solenoid plunger 78 unless there is a required change of state for the next horizontally adjacent pixel 20. This significantly reduces the number of cycles that a solenoid has to fire, since any contiguous set or reset only requires one firing cycle. The two-step firing cycle consists of applying full voltage F to solenoid 38 for a fixed period, about 40 milliseconds in the preferred embodiment, and a significantly lower "HOLD" voltage H for the remaining time the solenoid must be activated. The current necessary to fire solenoid 38 is 2–3 times higher than the current required to "HOLD" the solenoid. The voltage on each solenoid 38 is removed (reference voltage 0) when the plunger 38 is required to return to it position inactivated. Solenoids 38 are preferably selected at higher voltages, such as 24–36 volts DC, as opposed to 12 volts DC. Increasing the operating voltages reduces the current requirements, which reduces voltage drops due to the resistance of the signal cable 36. Reducing operating currents also allows for the use of smaller gauge wire, which reduces manufacturing costs. However, operating at higher voltages requires more stringent design to minimize safety hazards.

Therefore, the present invention provides a changeable sign that is fully modular, both in the horizontal and vertical directions. The pixels of this changeable sign undergo smooth rotation with a minimum of bounce. Such a smooth rotation is effectuated by configuring the center of gravity of the pixels so as to interact with an external force applied to the pixels.

The changeable sign operates on reduced power levels by driving the carriages, which carry solenoids adapted for rotation of the pixels, with only a single cable drive system. Also, the sign reduces power consumption by using a two-step fire-and-hold process wherein the solenoid drive voltage is reduced after firing to hold the solenoid in position.

The embodiments shown and described herein have been for the purpose of illustration of the invention. Those of ordinary skill in the art will appreciate that the invention can be carried out in various forms other than those specifically shown. Such variations are deemed to be within the scope of the claims. Also, various combinations and subcombinations of the features of the invention can be used without going beyond the scope of the invention.

We claim:

1. A modular display apparatus for displaying indicia at a front thereof, comprising:

an inner frame having horizontal support beams, said inner frame supporting a plurality of grid modules, at least one said grid module being located above another of said grid modules;

a plurality of pixels rotationally mounted to said grid modules and arranged into a matrix of rows and columns, said pixels each including at least two display faces, only one of which will be displayed at a given time for providing a desired arrangement of said display faces at said front of said display apparatus, wherein a weight is attached to each said pixel, to locate a center of gravity at a point on the second display face opposite to adjacent edges of the first and second display faces and at the rear of said display apparatus when said pixel is in its initial position; and a triggering mechanism adapted for bidirectional movement behind said pixels and for selective rotation of selected ones of said pixels for changing the desired arrangement of said display faces.

2. The apparatus of claim 1, where each said grid module is a one-piece injection molded matrix integrally including:

a plurality of mounting axles for rotationally mounting said pixels;

a plurality of molded mounting tabs for attaching said grid modules to a horizontal channel formed in each said horizontal support beams;

a plurality of molded stop tabs to restrict the rotation of said pixels; and a plurality of molded flags located on said grid module to indicate a position reference to said triggering mechanism.

3. The apparatus of claim 2, wherein said grid module has a front and a rear and a top and a bottom, and wherein a plurality of said mounting tabs are molded to said top of said rear and a plurality of said mounting tabs are molded to said bottom of said rear, said top mounting tabs and said bottom mounting tabs being staggered with respect to each other to allow said top and bottom tabs of vertically stacked modules to fit interstitially into the same said horizontal channel.

4. The apparatus of claim 2, where the dimensions of said grid module are designed to allow said grid modules to be placed close enough together, in the vertical and horizontal planes, that they appear as one continuous large grid.

5. The apparatus of claim 2, where each said grid module has an outer edge with corners, each said grid module having one of said corners anchored to said horizontal channel, said corner being the same on each horizontally aligned said grid module, to force any thermal expansion of said horizontally aligned grid modules to occur in a uniform direction, thereby minimizing misalignment due to thermal expansion.

6. The apparatus of claim 1, where said triggering mechanism is further comprised of a plurality of vertically arrayed carriages, and a cable drive system, each said carriage carrying a plurality of actuators.

7. The apparatus of claim 1, wherein each said horizontal beam has an upper surface and a lower surface, and upper and lower protuberances formed in said upper surface and said lower surface, respectively, each said upper and lower protuberances configured to accept at least one carriage, said carriage carrying a plurality of actuators.

8. A display apparatus for displaying indicia at a front thereof, comprising:

a frame having horizontal support beams, said frame supporting a plurality of rotationally mounted pixels arranged into a matrix of rows and columns, said pixels each including at least two display faces, only one of which will be displayed at a given time for providing a desired arrangement of said display faces at said front of said display apparatus;

a triggering mechanism adapted for bidirectional movement behind said pixels along a plurality of protuberances formed in said horizontal support beams; and a single cable drive system including a cable:

1) a series of pulleys to provide directional movement to said cable;

2) said cable routed around said frame by said series of pulleys so that portions of said cable move in the same direction at the top and bottom of said frame;

3) a motor;

4) a drum rotatable to wrap said cable.

9. The apparatus of claim 8, further comprising at least two vertically stacked carriages, each having a top and a bottom edge, each said carriage carrying a plurality of actuators adapted for selective rotation of said pixels, there being one carriage for a predetermined number of horizontal rows of said pixels, and said vertically stacked carriages being connected by brackets to ensure uniform horizontal movement.

10. The apparatus of claim 9, wherein said brackets allow vertical movement between said carriages to prevent binding of said carriages on said horizontal support beams.

11. The apparatus of claim 9, where in said vertically stacked carriages are connected to said cable drive system by additional said brackets, one said bracket attached to the top edge of the uppermost vertically stacked carriage and one said bracket attached to the bottom edge of the lowermost vertically stacked carriage.

12. The apparatus of claim 8, where said single cable drive system comprises:

a single cable;

a single motor;

a drum with a concave surface rotatable to wrap said cable; and a series of pulleys to provide directional movement to said cable.

13. The apparatus of claim 12, where said single cable is routed around said rear of said frame by two sets of cable pulleys providing a 90 degree direction feed and two sets of cable pulleys providing a 180 degree direction change, so that portions of said cable move in the same direction at the top and bottom of said frame.

14. A modular display apparatus for displaying indicia at a front thereof, comprising:

a frame:

a plurality of pixels rotationally supported in said frame and arranged into a matrix of rows and columns, said pixels each including at least two display faces, only one of which will be displayed at a given time, for providing a desired arrangement of said display faces at said front of said display apparatus;

a triggering mechanism adapted for bidirectional movement behind said pixels, said triggering mechanism having a plurality of solenoids adapted for selective actuation to rotate selected ones of said pixels for changing the pattern of said desired display indicia, said solenoids being controlled by an electronic signal transmitted from said electronics system through a signal cable; and an electronics system which causes said solenoids to fire in two steps, including a first step of applying fall voltage to each said solenoid for a fixed period of time and a second step of applying a significantly lower "hold" voltage to said solenoid for the remaining time said solenoid is activated.

15. The apparatus of claim 14 wherein said electronics system causes selected ones of said solenoids to fire when it is desired to change the state of selected ones of said pixels and said solenoids is held in the fired position as long as there is a required change of state for the next horizontally adjacent pixel.

16. The apparatus of claim 14 wherein said solenoids are rated between 24 and 48 volts to reduce the current requirements of said solenoids, which reduces voltage drops in said signal cable.

17. A modular display apparatus, having a front and a rear, for displaying indicia at said front thereof comprising:

an inner frame supporting a plurality of pixels;

said plurality of pixels supported on said inner frame having a center of gravity and an axis of rotation, said pixels each including first and second display faces joined along respective adjacent edges, each said pixel having an initial position such that said first display face is substantially vertical and said second display face is above said first display face and substantially horizontal and protruding toward said rear of said display apparatus, said center of gravity being located on said pixel so as to interact with an external force applied to said pixels to provide a complete rotation to display a desired said display face, wherein a weight is attached to each said pixel, to locate said center of gravity at a point on said second display face opposite to said joined edges of said first and second display faces and at the rear of said display apparatus when said pixel is in its initial position.

18. The apparatus of claim 17, wherein said weight is mounted to be able to shift diagonally across a vertical plane of said axis of rotation, shifting said center of gravity as said pixels rotate.

19. The apparatus of claim 18, where said movable weight comprises a pivoting weight attached to a point on said second display face opposite to said joined edges of said first and second display faces at the rear of said display apparatus when said pixel is in its initial position.

20. The apparatus of claim 18, where said movable weight comprises a tube containing dense, flowable material.

21. A modular display apparatus for displaying indicia at a front thereof, said indicia being formed from a plurality of pixels adapted for rotation when struck by a triggering mechanism, comprising:

A) said plurality of pixels rotationally supported by a plurality of grid modules and arranged into a matrix of rows and columns, said pixels each including at least two display faces, only one of which will be displayed at a given time, for providing a desired arrangement of said display faces at said front of said display apparatus;

B) said triggering mechanism adapted for bidirectional movement behind said pixels along a plurality of protuberances, one of said protuberances being formed in each upper and lower surfaces of a plurality of horizontal support beams of an inner frame, and for selective rotation of selected ones of said pixels for changing the pattern of a desired display indicia, said triggering mechanism being comprised of a plurality of carriages, each carrying a plurality of actuators, and a cable drive system and C) a single cable drive system including a cable:

1) a series of pulleys to provide directional movement to said cable;

2) said cable routed around said frame by said series of pulleys including at least two sets of cable pulleys providing a 90 degree direction feed and at least one pair of cable pulleys providing a 180 degree direction change, so that portions of said cable move in the same direction at the top and bottom of the said frame;

3) a motor;

4) a drum rotatable to wrap said cable.

22. A modular display apparatus for displaying indicia at a front thereof, comprising:

A) an inner frame having horizontal support beams, said inner frame supporting a plurality of grid modules;

B) a plurality of pixels rotationally mounted to said grid modules and arranged into a matrix of rows and columns, said pixels each including at least two display faces, only one of which will be displayed at a given time for providing a desired arrangement of said display faces at said front of said display apparatus;

C) a single cable drive system including a cable:

1) a series of pulleys to provide directional movement to said cable;

2) said cable routed around said frame by said series of pulleys including at least two sets of cable pulleys providing a 90 degree direction feed and at least one pair of cable pulleys providing a 180 degree direction change, so that portions of said cable move in the same direction at the top and bottom of the said frame;

3) a motor;

4) a drum rotatable to wrap said cable; and

D) at least two vertically stacked said carriages, each carriages including a plurality of actuators adapted for selective rotation of ones of said pixels, there being one said carriage for a predetermined number of horizontal rows of said pixels, and said vertically stacked carriages being connected by brackets to provide uniform horizontal movement, said brackets allowing vertical movement between said carriages to prevent binding of said carriages, wherein said vertically stacked carriages are connected to said cable drive system by additional said brackets, one said additional bracket attached to the uppermost vertically stacked carriage and one said additional bracket attached to the lowermost vertically stacked carriage.

23. A modular display apparatus for displaying indicia at a front thereof, comprising:

a frame;

a plurality of pixels rotationally supported in said frame and arranged into a matrix of rows and columns, said pixels each including at least two display faces, only one of which will be displayed at a given time, for providing a desired arrangement of said display faces at said front of said display apparatus;

a triggering mechanism adapted for bidirectional movement behind said pixels, said triggering mechanism having a plurality of solenoids adapted for selective actuation to rotate selected ones of said pixels for changing the pattern of a desired display indicia, said solenoids electronics system through a signal cable, said solenoids operating at a sufficiently high voltage to reduce the current requirements for said solenoids voltage drops in said signal cable; and an electronics system which causes selected ones of said solenoids to fire in two steps, including a first step of applying full voltage to each said solenoid for a fixed period of time and a second step of applying a significantly lower "hold" voltage to said solenoid for the remaining time said solenoid is activated, wherein said two-step firing method causes a said solenoid to fire when it is desired to change the state of a said pixel and said solenoid is held in the fired position as long as there is a required change of state for the next horizontally adjacent pixel.

24. A modular display apparatus, having a front and a rear, for displaying indicia at said front thereof comprising:

an inner frame having horizontal support beams, said inner frame supporting a plurality of grid modules;

a plurality of pixels each having a predetermined center of gravity and an axis of rotation, said pixels rotationally mounted to said grid modules and arranged into a matrix of rows and columns, said pixels each including first and second display faces joined along respective adjacent edges, each said pixel having an initial position such that said first display face is substantially vertical and said second display face is above said first display face and substantially horizontal and protruding toward said rear of said display apparatus, said pixels also having a weight distribution such that said center of gravity will interact with an external force applied to said pixels to provide a smooth rotation with a minimum of bounce, said weight distribution achieved by a fixed weight attached to each said pixel, distributing said center of gravity symmetrically around a point on said second display face, said point being opposite to said joined edges of said first and second display faces and at said rear of said display apparatus when said pixel is in said initial position.

25. A modular display apparatus for displaying indicia at a front thereof, said indicia being formed from a plurality of pixels adapted for rotation when struck by a triggering mechanism, comprising:

A) an inner frame having horizontal support beams, each said horizontal beam having an upper surface and a lower surface, and said inner frame supporting a plurality of grid modules with dimensions designed to allow said grid modules to be placed close enough together, in the vertical and horizontal planes, that they appear as one continuous large grid, at least one said grid module being located above another of said grid modules, and wherein each said grid module is a one-piece injection molded matrix, having a front and a rear, a top and a bottom, and an outer edge with corners, said grid modules including:

1) a plurality of mounting axles for rotationally mounting said pixels;

2) a plurality of molded mounting tabs for attaching said grid modules to horizontal channels formed in said horizontal support beams, a plurality of said mounting tabs being molded to said top of said rear and a plurality of said mounting tabs being molded to said bottom of said rear, said top mounting tabs and said bottom mounting tabs being staggered with respect to each other to allow said top and said bottom tabs of vertically stacked grid modules to fit interstitially into the same said horizontal channel, each said grid module having one said corner anchored to said horizontal channel, said corner being the same on each horizontally aligned said grid module, to force any thermal expansion of said horizontally aligned grid modules to occur in a uniform direction, thereby minimizing misalignment due to thermal expansion;

3) a plurality of molded stop tabs to restrict the rotation of said pixels; and 4) a plurality of molded flags to indicate a position reference to said triggering mechanism;

B) said plurality of pixels each having a predetermined center of gravity and an axis of rotation, said pixels rotationally mounted to said grid modules and arranged into a matrix of rows and columns, said pixels each including first and second display faces joined along respective adjacent edges, only one of said display faces being displayed at a given time for providing a desired arrangement of said display faces at said front of said display apparatus, each said pixel having a first position such that said first display face is substantially vertical and said second display face is above said first display face and substantially horizontal and protruding toward said rear of said display apparatus, said pixels also having a weight distribution such that said center of gravity will interact with an external force applied to said pixels to provide smooth rotation with a minimum of bounce, said weight distribution achieved by a fixed weight attached to each said pixel; and C) a triggering mechanism adapted for bidirectional movement behind said pixels along a plurality of protuberances, one of said protuberances being formed in each said upper and lower surfaces of said horizontal support beams, said triggering mechanism including a cable drive system and a plurality of carriages, each said carriage carrying a plurality of solenoids adapted for selective actuation to rotate selected said pixels for changing the pattern of a desired display indicia, said solenoids being controlled by an electronics system which causes said solenoids to fire in a two-step firing method, including a first step of applying full voltage to each said solenoid for a fixed period of time and a second step of applying a significantly lower "hold" voltage to said solenoid for the remaining time said solenoid is activated.

26. A modular display apparatus for displaying indicia at a front thereof, comprising:

a plurality of pixels rotationally mounted to grid modules and arranged into a matrix of rows and columns, said pixels each including at least two display faces, only one of which will be displayed at a given time for providing a desired arrangement of said display faces at said front of said display apparatus;

a triggering mechanism adapted for bidirectional movement behind said pixels, said triggering mechanism having a plurality of solenoids adapted for selective actuation to rotate selected ones of said pixels for changing the pattern of a desired display indicia, said solenoids being controlled by an electronic signal transmitted from an electronics system through a signal cable: and an electronics system which causes said solenoids to fire in two steps, including a first step of applying full voltage to each said solenoid for a fixed period of time and a second step of applying a significantly lower "hold" voltage to said solenoid for the remaining time said solenoid is activated.

27. A modular display apparatus for displaying indicia at a front thereof, comprising:

an inner frame having horizontal support beams, said inner frame supporting a plurality of grid modules, at least one said grid module being located above another of said grid modules;

a plurality of pixels rotationally mounted to said grid modules and arranged into a matrix of rows and columns, said pixels each including at least two display faces, only one of which will be displayed at a given time for providing a desired arrangement of said display faces at said front of said display apparatus;

a triggering mechanism adapted for bidirectional movement behind said pixels, said triggering mechanism having a plurality of solenoids adapted for selective actuation to rotate selected ones of said pixels for changing the pattern of a desired display indicia, said solenoids being controlled by an electronic signal transmitted from an electronics system through a signal cable; and an electronics system which causes said solenoids to fire in two steps, including a first step of applying full voltage to each said solenoid for a fixed period of time and a second step of applying a significantly lower "hold" voltage to said solenoid for the remaining time said solenoid is activated.

28. A modular display apparatus, having a front and a rear, for displaying indicia at said front thereof comprising:

an inner frame having horizontal support beams, said inner frame supporting a plurality of grid modules, at least one said grid module being located above another of said grid modules;

a plurality of pixels rotationally mounted to said grid modules and arranged into a matrix of rows and columns, said pixels having a center of gravity and an axis of rotation, said pixels each including first and second display faces joined along respective adjacent edges, each said pixel having an initial position such that said first display face is substantially vertical and said second display face is above said first display face and substantially horizontal and protruding toward said rear of said display apparatus, said center of gravity being located on said pixel so as to interact with an external force applied to said pixels to provide a complete rotation to display a desired said display face, wherein a weight is attached to each said pixel, to locate said center of gravity at a point on said second display face opposite to said joined edges of said first and second display faces and at the rear of said display apparatus when said pixel is in its initial position; and a triggering mechanism adapted for bidirectional movement behind said pixels and for selective rotation of selected ones of said pixels for changing the desired arrangement of said display faces.

29. A display apparatus for displaying indicia at a front thereof, comprising:

a frame having horizontal support beams, said frame supporting a plurality of rotationally mounted pixels arranged into a matrix of rows and columns, said pixels each including at least two display faces, only one of which will be displayed at a given time for providing a desired arrangement of said display faces at said front of said display apparatus;

a triggering mechanism adapted for bidirectional movement behind said pixels, said triggering mechanism having a plurality of solenoids adapted for selective actuation to rotate selected ones of said pixels for changing the pattern of a desired display indicia, said solenoids being controlled by an electronic signal transmitted from an electronics system through a signal cable;

an electronics system which causes said solenoids to fire in two steps, including a first step of applying full voltage to each said solenoid for a fixed period of time and a second step of applying a significantly lower "hold" voltage to said solenoid for the remaining time said solenoid is activated; and a single cable drive system for driving said triggering mechanism in bidirectional motion.

30. A display apparatus, having a front and a rear, for displaying indicia at said front thereof comprising:

a frame having horizontal support beams, said frame supporting a plurality of rotationally mounted pixels arranged into a matrix of rows and columns, said pixels each including at least two display faces, only one of which will be displayed at a given time for providing a desired arrangement of said display faces at said front of said display apparatus;

said plurality of pixels supported on an inner frame having a center of gravity and an axis of rotation, said pixels each including first and second display faces joined along respective adjacent edges, each said pixel having an initial position such that said first display face is substantially vertical and said second display face is above said first display face and substantially horizontal and protruding toward said rear of said display apparatus, said center of gravity being located on said pixel so as to interact with an external force applied to said pixels to provide a complete rotation to display a desired said display face;

a triggering mechanism adapted for bidirectional movement behind said pixels along a plurality of protuberances formed in said horizontal support beams; and a single cable drive system including a cable:

1) a series of pulleys to provide directional movement to said cable;

2) said cable routed around said frame by said series of pulleys including at least two sets of cable pulleys providing a 90 degree direction feed and at least one pair of cable pulleys providing a 180 degree direction change, so that portions of said cable move in the same direction at the top and bottom of the said frame;

3) a motor;

4) a drum rotatable to wrap said cable.

31. A modular display apparatus, having a front and a rear, for displaying indicia at said front thereof comprising:

a frame:

a plurality of pixels rotationally supported in said frame and arranged into a matrix of rows and columns, said pixels each including at least two display faces, only one of which will be displayed at a given time, for providing a desired arrangement of said display faces at said front of said display apparatus;

said plurality of pixels supported on an inner frame having a center of gravity and an axis of rotation, said pixels each including first and second display faces joined along respective adjacent edges, each said pixel having an initial position such that said first display face is substantially vertical and said second display face is above said first display face and substantially horizontal and protruding toward said rear of said display apparatus, said center of gravity being located on said pixel so as to interact with an external force applied to said pixels to provide a complete rotation to display a desired said display face;

a triggering mechanism adapted for bidirectional movement behind said pixels, said triggering mechanism having a plurality of solenoids adapted for selective actuation to rotate selected ones of said pixels for changing the pattern of a desired display indicia, said solenoids being controlled by an electronic signal transmitted from an electronics system through a signal cable; and an electronics system which causes said solenoids to fire in two steps, including a first step of applying full voltage to each said solenoid for a fixed period of time and a second step of applying a significantly lower "hold" voltage to said solenoid for the remaining time said solenoid is activated.

32. A modular display apparatus, having a front and a rear, for displaying indicia at said front thereof comprising:

an inner frame having horizontal support beams, said inner frame supporting a plurality of grid modules, at least one said grid module being located above another of said grid modules;

a plurality of pixels rotationally mounted to said grid modules and arranged into a matrix of rows and columns;

said pixels having a center of gravity and an axis of rotation, said pixels each including first and second display faces joined along respective adjacent edges, each said pixel having an initial position such that said first display face is substantially vertical and said second display face is above said first display face and substantially horizontal and protruding toward said rear of said display apparatus, said center of gravity being located on said pixel so as to interact with an external force applied to said pixels to provide a complete rotation to display a desired said display face;

a triggering mechanism adapted for bidirectional movement behind said pixels along a plurality of protuberances formed in said horizontal support beams, said triggering mechanism having a plurality of solenoids adapted for selective actuation to rotate selected ones of said pixels for changing the pattern of a desired display indicia, said solenoids being controlled by an electronic signal transmitted from an electronics system through a signal cable;

an electronics system which causes said solenoids to fire in two steps, including a first step of applying full voltage to each said solenoid for a fixed period of time and a second step of applying a significantly lower "hold" voltage to said solenoid for the remaining time said solenoid is activated; and a single cable drive system for driving said triggering mechanism in bidirectional motion.

* * * * *

UNITED STATES PATENT AND TRADEMARK OFFICE

CERTIFICATE OF CORRECTION

PATENT NO. : 5,751,269

DATED : May 12, 1998

INVENTOR(S) : F. Martin Black et al.

It is certified that error appears in the above—identified patent and that said Letters Patent is hereby corrected as shown below:

In Claim 14, line 5, "said" should be --an--. (Col 11)

In Claim 14, line 7, "an electronics" should be --said electronics--. (Col. 11)

In Claim 22, Section D), line 2, "carriages" should be --said carriage--.

In Claim 22, Section D), line 1, delete "said".

Signed and Sealed this

Seventeenth Day of November, 1998

*Attest:*

Bruce Lehman

BRUCE LEHMAN

*Attesting Officer*

*Commissioner of Patents and Trademarks*